US007010242B2

(12) United States Patent
Suzuki et al.

(10) Patent No.: US 7,010,242 B2
(45) Date of Patent: Mar. 7, 2006

(54) IMAGE FORMING APPARATUS

(75) Inventors: Takashi Suzuki, Ibaraki (JP); Masayuki Ainoya, Ibaraki (JP); Junji Shirakawa, Ibaraki (JP); Yoshitaka Fujinuma, Ibaraki (JP); Koji Kato, Ibaraki (JP); Kazuo Sunou, Ibaraki (JP)

(73) Assignee: Ricoh Printing Systems, Inc., Tokyo (JP)

( * ) Notice: Subject to any disclaimer, the term of this patent is extended or adjusted under 35 U.S.C. 154(b) by 0 days.

(21) Appl. No.: 10/602,776

(22) Filed: Jun. 25, 2003

(65) Prior Publication Data

US 2004/0028436 A1 Feb. 12, 2004

(30) Foreign Application Priority Data

Jun. 26, 2002 (JP) ..... P.2002-186521

(51) Int. Cl.
*G03G 15/00* (2006.01)

(52) U.S. Cl. ..... 399/110; 399/107; 399/361; 399/397

(58) Field of Classification Search ..... 399/107, 399/110, 397, 401, 361, 393
See application file for complete search history.

(56) References Cited

U.S. PATENT DOCUMENTS 5,208,640 A * 5/1993 Horie et al. ..... 399/110
5,598,257 A * 1/1997 Keller et al. ..... 399/364
5,930,556 A * 7/1999 Imamiya ..... 399/66
6,256,463 B1 * 7/2001 Manzer et al. ..... 399/76
6,269,237 B1 * 7/2001 Olbrich et al. ..... 399/401
6,331,004 B1 * 12/2001 Katou et al. ..... 271/301
6,374,066 B1 * 4/2002 Smith et al. ..... 399/107
6,381,440 B1 4/2002 Bock et al. ..... 399/394
6,389,253 B1 * 5/2002 Nonomura et al. ..... 399/149
6,615,732 B1 * 9/2003 Hunold et al. ..... 101/486

FOREIGN PATENT DOCUMENTS

DE 201 19 854 U1 5/2001
EP 0 627 671 B1 2/1997

OTHER PUBLICATIONS

German Office Action dated Oct. 7, 2004.

* cited by examiner

*Primary Examiner*—Andrew H. Hirshfeld
*Assistant Examiner*—Dave A. Ghatt
(74) *Attorney, Agent, or Firm*—McGinn IP Law Group, PLLC

(57) ABSTRACT

An image forming apparatus includes: a first image forming unit having a first printing section for forming a first image on the paper; a second image forming unit having a second printing section for forming a second image on the paper; and a paper conveying unit for conveying the paper from the first image forming unit to the second image forming unit. Accordingly, two kinds of image can be formed employing one image forming apparatus. The first image and the second image may be formed using the same recording material (toner) or different recording materials (toners).

22 Claims, 4 Drawing Sheets

IMAGE FORMING APPARATUS

BACKGROUND OF THE INVENTION

1. Field of the Invention

The present invention relates to an image forming apparatus using an electrophotographic method.

2. Background Art

The image forming apparatus using the electrophotographic method is employed to produce various kinds of printed matter, in which the special toner may be employed for the printing. Herein, the printing with MICR (Magnetic Ink Character Recognition) will be described below as an example.

MICR means a system for printing a special calligraphic style called an MICR font on a part of the check or financial document using the magnetic ink and the magnetic toner (MICR toner), reading the MICR font by an apparatus called an MICR reader/sorter, and performing the processing such as classification. This MICR is widely spread especially in Europe and the United States.

The MICR toner contains a large amount of ferromagnetic particles of pure iron, ferrite, iron oxide or magnetite. If the MICR toner is employed for the printing apparatus, a fixing unit for fixing the MICR toner on the paper is greatly damaged on the surface of a heating roller by the ferromagnetic substance in the MICR toner, so that the life of the fixing unit is reduced to about one-third the ordinary length. Accordingly, if the MICR toner is employed in the printing without needing the MICR toner, a fixing roller is remarkably deteriorated and must be replaced frequently, whereby the cost is greatly increased.

Further, since the MICR toner is very expensive, the use of the MICR toner for the printing other than the MICR font increases the cost. The MICR font is only employed for the printing on apart of the check, and limited in the application.

The preprint is made employing a monochrome printer and a color printer for the normal printing, and then the MICR font is printed employing an MICR specific printer. In this case, the MICR specific printer has a lower frequency of use than in making all the printing, whereby the MICR specific printer is advantageous in the respect of the cost.

SUMMARY OF THE INVENTION

However, in making the preprint, it is necessary to prepare a plurality of printers, including the monochrome printer and the color printer for the preprint, and the specific printer for the MICR printing. Accordingly, the user must keep a space for arranging each printer in a floor. Furthermore, the user is required to take the measures against the environmental problems caused by the noise and eject from the plurality of printers.

Moreover, an operation including the preprint is complex in which the plurality of printers are used to perform different printings respectively, thereby reducing working efficiency. Further, in this methods possibility of causing a significant error such as missing data during the operation cannot be denied Therefore, that method is not the best printing method.

In recent years, since the personal computers have rapidly spread, there is an increasing need for printing output data from the personal computer at high speed. However, the above operation is difficult to meet this need, and desired for improvements.

It is an object of the present invention to provide an image forming apparatus that can make the fast printing process efficiently and cheaply. Particularly, it is another object of the invention to provide an image forming apparatus that can make the MICR printing efficiently, cheaply and reliably in the light of the MICR printing situation.

In order to accomplish the above object, the invention provides an image forming apparatus including: a first image forming unit having a first printing section for forming a first image on the paper, a second image forming unit having a second printing section for forming a second image on the paper, and a paper conveying unit for conveying the paper from the first image forming unit to the second image forming unit.

In this invention, the image forming apparatus is provided with the first printing section for forming the first image and the second printing section for forming the second image. Accordingly, two kinds of image can be formed employing one image forming apparatus.

The first image and the second image may be formed using the same recording material (toner) or different recording materials (toners)

Particularly, the first printing section may employ one of the ferromagnetic toner and the non-magnetic toner such as the MICR toner, and the second printing section may employ the other toner. In this configuration, the image forming apparatus can perform the printing with the MICR toner and the printing with other toner at the same time. Thereby, it is possible to resolve the problem that the printing with the MICR font is made in a portion where the MICR toner is unnecessary, and thus perform the MICR printing efficiently and reliably.

BRIEF DESCRIPTION OF THE DRAWINGS

The present invention may be more readily described with reference to the accompanying drawings.

DETAILED DESCRIPTION OF THE PREFERRED EMBODIMENTS

The preferred embodiments of the present invention will be described below in detail with reference to the accompanying drawings.

The First Preferred Embodiment

Figure 1:
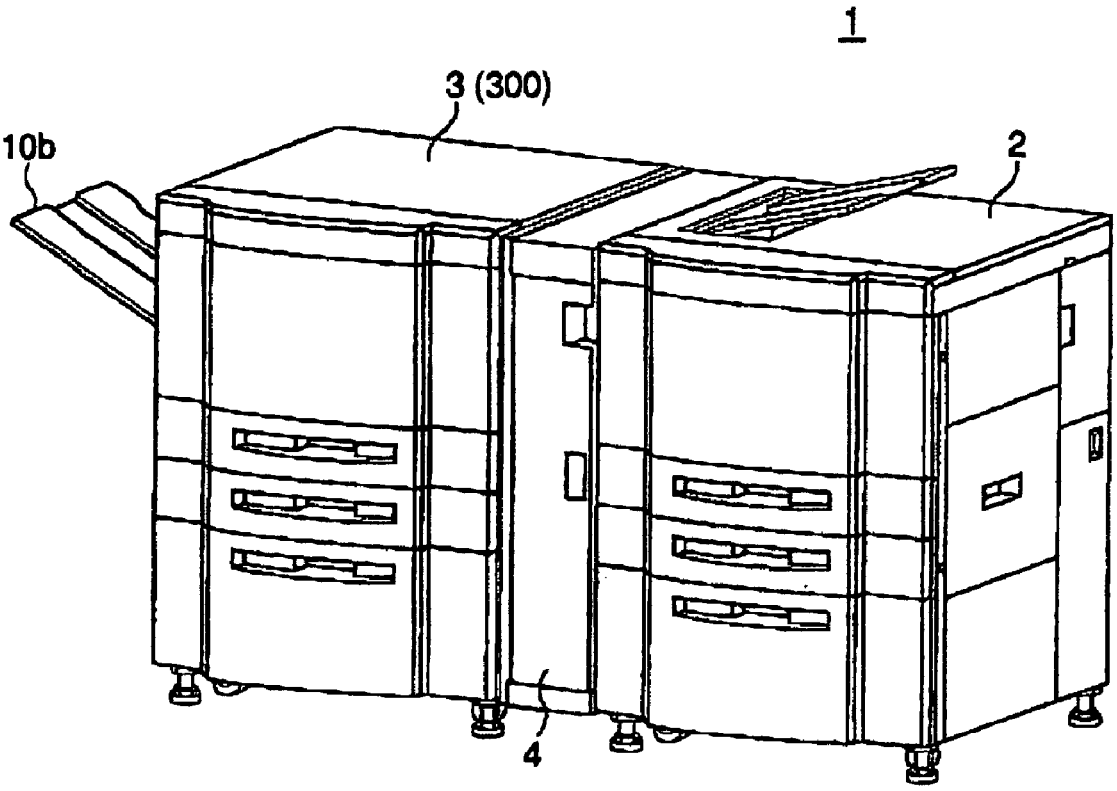
FIG. 1 is an appearance view showing a printer as an image forming apparatus according to a first embodiment of the present invention.

FIG. 1 is an appearance view showing a printer as an image forming apparatus according to a first embodiment of the present invention. The printer 1 of this embodiment is the image forming apparatus of the electrophotographic method, including a first printing unit 2 as a first image forming unit, a second printing unit 3 as a second image forming unit, and a paper conveying unit 4 disposed between the first printing unit 2 and the second printing unit 3.

Figure 2:
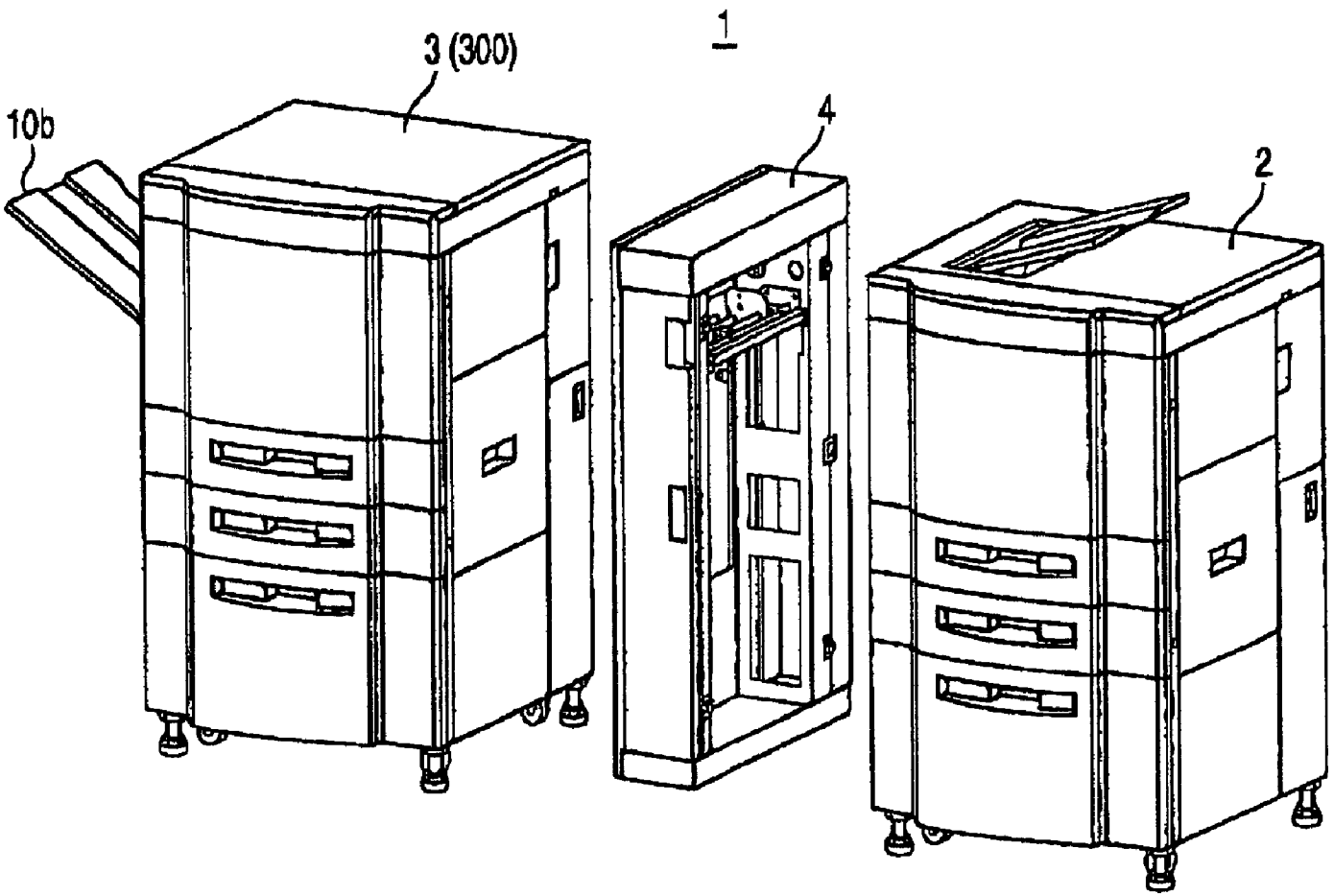
FIG. 2 is a view showing a state where the printer is separated into each unit.

FIG. 2 is a view showing a state where the printer is separated into each unit. As shown in FIG. 2, the first printing unit 2, the second printing unit 3 and the conveying unit 4 can be separated. Each of the first printing unit 2 and the second printing unit 3 has a power source and a print control device, and can be employed singly as the printer.

Figure 3:
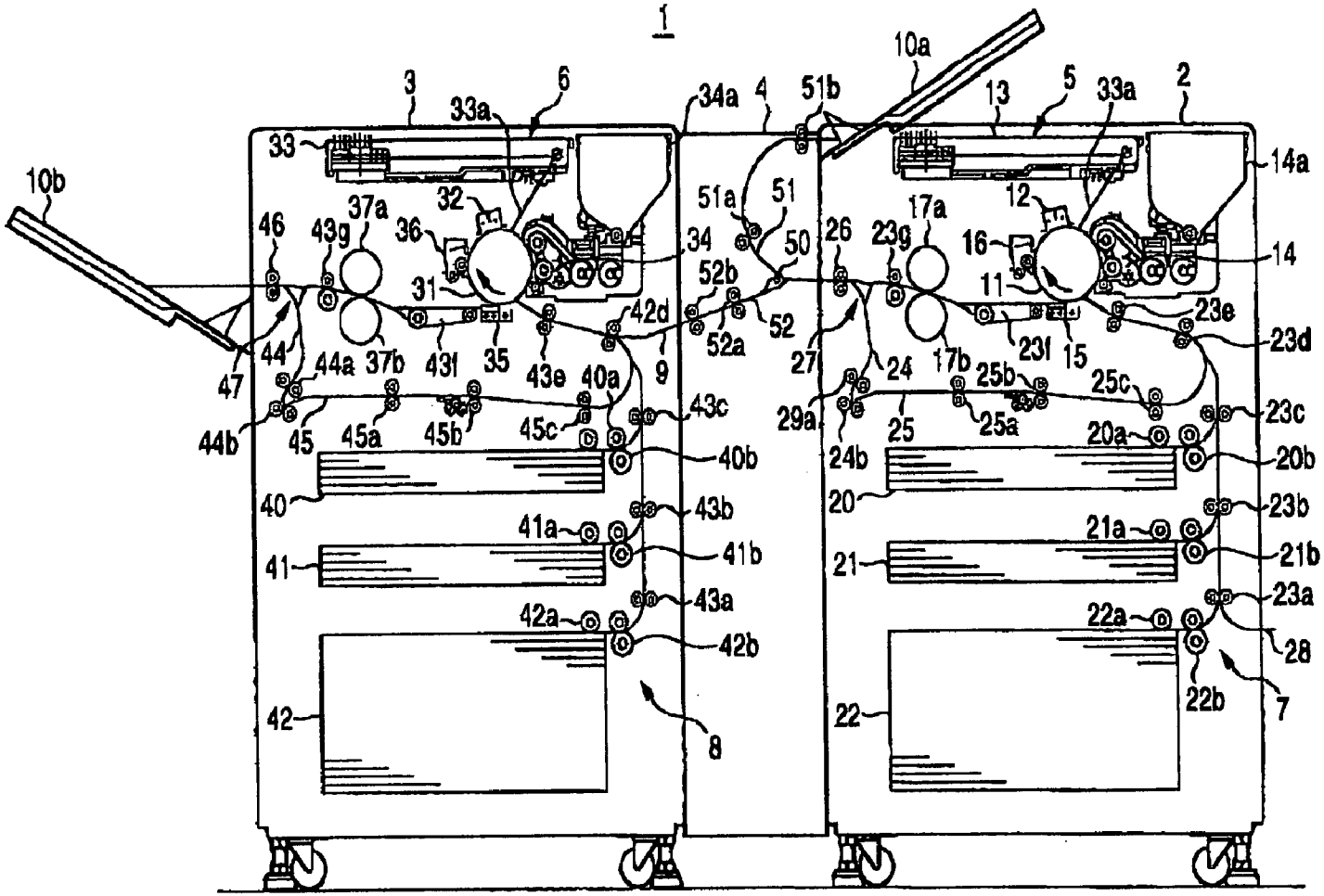
FIG. 3 is a cross-sectional view showing an internal structure of the printer according to the first embodiment of the invention.

FIG. 3 is a cross-sectional view showing an internal structure of the printer 1 according to the first embodiment of the invention. Referring to FIG. 3, the first printing unit 2 will be firstly described below.

The first printing unit 2 includes a printing section 5 for transferring and fixing the toner to the paper, a paper feeding section 7 for supplying the paper to the printing section 5, a gate 27 for selecting a conveying direction of the paper, a lead-in passage 24 for reversing the paper after printing and delivering it to the paper conveying unit 4, and a return passage 25 for supplying the reversed paper to the printing section 5 again. The print speed of the first printing unit 2 is 92 ppm.

The paper feeding section 7 is composed of the paper feed trays 20, 21 and 22, the paper take-up rollers 20*a*, 21*a* and 22*a*, and the paper conveying rollers 20*b*, 21*b*, 21*b*, and 23*a* to 23*e* for conveying the paper to the printing section 5. A plurality of paper feed trays 20, 21 and 22 contain the papers of predetermined size, supplying the paper from any one of the paper feed trays 20, 21 and 22 to the printing section 5 in response to a print request from a controller, not shown.

Also, the paper feed section 7 has an external paper section 28 for supplying the paper from outside the first printing unit 2. The paper supplied from the external paper section 28 is fed via the paper conveying rollers 23*a* to 23*e* to the printing section 5.

The printing section 5 includes a photosensitive drum 11, a corona charger 12, a laser radiating unit 13, a developing unit 14, a charger 15, a cleaning unit 16, and a heating roller 17*a* and a pressing roller 17*b* that are opposed to each other.

The photosensitive drum 11 is provided with a photoconductive layer on a metallic cylinder surface, and rotated in a direction of the arrow in accordance with an instruction from the controller, not shown, at the time of printing. Around the photosensitive drum 11, there are disposed in order the corona charger 12, the laser radiating unit 13, the developing unit 14, the charger 15 and the cleaning unit 16.

The corona charger 12 charges the surface of the photosensitive drum 11 uniformly by corona discharge along with the rotation of the photosensitive drum 11. The laser radiating unit 13 radiates a first laser 33*a* onto the photosensitive drum 11 in accordance with an image to be printed to form a latent image on the photosensitive drum 11. The developing unit 14 has a toner containing section 14 for containing the toner and develops and visualizes the latent image on the drum using the toner supplied from a toner containing section 14*a*. The toner may be the ferromagnetic toner for MICR or the black or color non-magnetic toner.

The charger 15 applies a positive bias to the back side of the paper fed from the paper feed section 7 to transfer on the toner on the photosensitive drum 11 to the paper. The paper to which the toner is transferred is fed between the heating roller 17*a* and the pressing roller 17*b* by a conveying unit 23*f*.

The heating roller 17*a* has a hollow core metal structure with aluminum (A5052 material) as a raw material, and is coated with fluororesin having a thickness of 35 micron on the surface. This fluororesin contributes to preventing the toner from sticking to the surface of the heating roller 17*a*. A halogen lamp is disposed as a heat source inside the heating roller 17*a*. This halogen lamp is controlled so that the surface of the heating roller 17*a* is kept at about 190° C. For this temperature control, a temperature sensor, not shown, is employed.

The pressing roller 17*b* presses the heating roller 17*a* at a predetermined pressure to apply heat and pressure to the paper passing between the heating roller 17*a* and the pressing roller 17*b*, and fix the toner on the paper.

The cleaning unit 16 removes the remaining toner not transferred onto the paper from the photosensitive drum 11, and cleans the surface of the photosensitive drum 11 for the next printing.

The gate 27 is disposed downstream of the heating roller 17*a* and the pressing roller 17*b*, the paper passed from the heating roller 17*a* and the pressing roller 17*b*is delivered to an ejecting roller 26, or the lead-in passage 24. The paper delivered to the ejecting roller 26 is conveyed to the paper conveying unit 4.

The lead-in passage 24 has the reversing rollers 24*a* and 24*b*. The reversing rollers 24*a* and 24*b* reverse the paper led into the lead-in passage 24 in response to a print request, and conveys the reversed paper via the lead-in passage 24 and the ejecting roller 26 to the paper conveying unit 4 again, or sends it to the return passage 25.

The return passage 25 has a plurality of paper conveying rollers 25*a*, 25*b* and 25*c* to send back the paper passed from the paper reversing roller 24*b* to the printing section 5 again. The paper delivered to the printing section 5 has the back face printed. Thereby, the paper is printed on both sides.

The paper conveying unit 4 will be described below.

The paper conveying unit 4 includes a branching unit 50, a first conveying passage 51 connected to the branching unit 50, and a second conveying passage 52 connected to the branching unit 50.

The branching unit 50 sends the paper passed from the first printing unit 2 to any one of the first conveying passage 51 and the second conveying passage 52. The branching unit 50 has a function of decurler to correct a heat curl produced by the heating roller 17*a* and the pressing roller 17*b* in the first printing unit 2.

The first conveying passage 51 ejects the paper via the paper conveying rollers 51*a* and 51*b* to the outside. The ejected paper is stacked on a paper eject tray 10*a* provided above the first printing unit 2. The second conveying passage 52 conveys the paper via the paper conveying rollers 52*a* and 52*b* to the second printing unit 3.

The second printing unit 3 will be now described.

The second printing unit 3 includes a printing section 6, a paper feeding section 8, a gate 47, a lead-in passage 44 and a return passage 45. The printing section 6, the paper feeding section 8, the gate 47, the lead-in passage 44 and the return passage 45 have the same structure and function as the printing section 5, the paper feeding section 7, the gate 27, the lead-in passage 24 and the return passage 25 of the first printing unit 2, respectively. The second printing unit 3 can perform the processing at the same print speed of 92 ppm as the first printing unit 2.

Herein, the printing section 6 of the second printing unit 3 and the printing section 5 of the first printing unit 2 can be exchanged. Each printing section can make the printing on the same paper independently. In this embodiment, a toner containing section 34*a* may contain the same kind of toner as the toner containing section 14*a* of the printing section 5, or may contain the different kind of toner.

The paper feed section 8 supplies the paper to the printing section 6 when the printing is not made using the first printing unit 2.

The second printing unit 3 further comprises a paper conveying passage 9 for accepting the paper passed from the paper-conveying unit 4. The downstream side of the paper conveying passage 9 is connected to the upstream side of the paper-conveying roller 43*d*. The paper passed from the paper-conveying unit 4 is delivered via the paper conveying rollers 43*d* and 43*e* to the printing section 6

The second printing unit 3 is provided with a paper eject tray 10*b*. The paper printed by the printing section 6 is ejected via a guide 47 and an eject roller 46 to the outside, and stacked on the paper eject tray 10*b*.

A printing method using the printer 1 of this embodiment will be described below. The printer 1 can perform the one-side monochrome printing, the perfect monochrome printing, the one-side two-color printing and the perfect two-color printing. Each printing method will be described in detail.

<1. One-Side Monochrome Printing>

First of all, the one-side monochrome printing has a first printing method using the first printing unit 2 and the paper conveying unit 4 and a second printing method using the second printing unit 3.

(1.1: First Printing Method)

Firstly, the first printing method for the one-side monochrome printing using the first printing unit 2 will be described. First of all, the size of paper for use is selected by operating an operation panel, not shown. The printer 1 supplies the paper of the selected size from the paper feed trays 20 to 22 to the printing section 5 in the first printing unit.

The photosensitive drum 11 of the printing section 5 transfers the toner onto the fed paper. The transferred toner is fixed on the paper by the heating roller 17*a* and the pressing roller 17*b*. After fixing, the paper is conveyed via the ejecting roller 26 to the paper conveying unit 4. The paper conveying unit 4 supplies the paper via the branching section 50 to the first conveying passage 51. The paper supplied to the first conveying passage 51 is ejected via the conveying rollers 51*a* and 51*b* onto the paper tray 10*a*. With the above, the one-side monochrome printing is completed.

(1.2: Second Printing Method)

Next, the second printing method for the one-side monochrome printing using the second printing unit 3 will be described. First of all, the size of paper for use is selected by operating the operation panel. The printer 1 supplies the paper of the selected size from the paper feed trays 40 to 42 to the printing section 6 in the second printing unit.

A photosensitive drum 31 of the printing section 6 transfers the toner onto the fed paper. The transferred toner is fixed on the paper by the heating roller 37*a* and the pressing roller 37*b*. After fixing, the paper is conveyed via the ejecting roller 46 onto the paper tray 11*b*. With the above, the one-side monochrome printing is completed.

The one-side monochrome printing can be made using any one of the first printing unit 2 and the second printing unit 3. The user needs to appropriately select which printing unit to employ in accordance with the remaining amount of paper or the kind of toner. Also, the printer 1 may automatically select which printing unit to employ in the accordance with the use frequencies of the printing section 5 and 6.

<2. Perfect Monochrome Printing>

Next, the perfect monochrome printing has three kinds of printing methods, including a third printing method using the first printing unit 2 alone, a fourth printing method using the second printing unit alone, and a fifth printing method using the first printing unit 2, the second printing unit 3 and the paper conveying unit 4.

(2.1: Third Printing Method)

Firstly, the third printing method for the perfect monochrome printing using the first printing unit 2 will be described. First of all, the size of paper for use is selected by operating the operation panel. The printer 1 supplies the paper of the selected size from the paper feed trays 20 to 22 to the printing section 5 in the first printing unit.

The photosensitive drum 11 of the printing section 5 transfers the toner onto the surface of the fed paper. The transferred toner is fixed on the paper by the heating roller 17*a* and the pressing roller 17*b*. Thereafter, the paper is led via the gate 27 into the lead-in passage 24, and switched back by the reversing rollers 24*a* and 24*b*. The switched back paper is delivered in a reversed state via the return passage 25 to the printing section 5 again.

The photosensitive drum 11 of the printing section 5 transfers the toner onto the back face of the paper passed via the return passage 25. The transferred toner is fixed on the paper by the heating roller 17*a* and the pressing roller 17*b*. After fixing, the paper is conveyed via the ejecting roller 26 to the paper conveying unit 4. The paper conveying unit 4 supplies the paper via the branching section 50 to the first conveying passage 51 The paper supplied to the first conveying passage 51 is ejected via the conveying rollers 51*a* and 51*b* onto the paper tray 10*a*. With the above, the perfect monochrome printing is completed.

(2.2: Fourth Printing Method)

Firstly, the fourth printing method for the perfect monochrome printing using the second printing unit 3 will be described. First of all, the size of paper for use is selected by operating the operation panel. The printer 1 supplies the paper of the selected size from the paper feed trays 40 to 42 to the printing section 6 in the second printing unit.

The photosensitive drum 31 of the printing section 6 transfers the toner onto the surface of the fed paper. The transferred toner is fixed on the paper by the heating roller 37*a* and the pressing roller 37*b*. Thereafter, the paper is led via the gate 47 into the lead-in passage 44, and switched back by the reversing rollers 44*a* and 44*b*. The switched back paper is delivered in a reversed state via the return passage 45 to the printing section 6 again.

The photosensitive drum 31 of the printing section 6 transfers the toner onto the back face of the paper passed via the return passage 45. The transferred toner is fixed on the paper by the heating roller 37*a* and the pressing roller 37*b*. After fixing, the paper is conveyed via the ejecting roller 46 onto the paper tray 10*b*. With the above, the perfect monochrome printing is completed.

(2.3: Fifth Printing Method)

Next, the fifth printing method for the perfect monochrome printing using the first printing unit 2, the second printing unit 3 and the paper conveying unit 4 will be described. In this method, the first printing unit 2 and the second printing unit 3 use the same kind of toner.

First of all, the size of paper for use is selected by operating the operation panel. The printer 1 supplies the paper of the selected size from the paper feed trays 20 to 22 to the printing section 5 in the first printing unit.

The photosensitive drum 11 of the printing section 5 transfers the toner onto the surface of the fed paper, The transferred toner is fixed on the paper by the heating roller 17*a* and the pressing roller 17*b*. After fixing, the paper is led via the gate 27 into the lead-in passage 24, and switched back by the reversing rollers 24*a* and 24*b*. The switched back paper is delivered in a reversed state via the gate 27 and the eject roller 26 to the paper conveying unit 4.

The paper conveying unit 4 supplies the paper via the branching section 50 to the second conveying passage 52. The paper supplied to the second conveying passage 52 is conveyed via the conveying rollers 52*a* and 52*b* to the second printing unit 3.

The second printing unit 3 conveys the conveyed paper via the paper conveying passage 9 and the conveying rollers 43 and 43*e* to the printing section 6. The photosensitive drum 31 of the printing section 6 transfers the toner onto the back face of the fed paper. The transferred toner is fixed on the paper by the heating roller 37*a* and the pressing roller 37*b*. After fixing, the paper is ejected via the ejecting roller 46 onto the paper tray 10*b*. With the above, the perfect monochrome printing is completed.

The use of any one of the third to fifth methods can provide the same printed result. Particularly, with the fifth printing method, since two printing sections can perform the printing process at the same time, the printing efficiency is enhanced as compared with the conventional printing apparatus or the third and fourth printing methods.

In the perfect printing with the conventional and third and fourth printing methods, since it is required that the paper is passed twice through the same printing section within the apparatus, the print speed of the perfect printing is as high as about half the number of printing sheets in the one-side printing. For example, if the print speed is 92 ppm in the one-side printing, the print speed in the perfect printing is 46 ppm.

On the other hand, the first printing unit and the second printing unit of this embodiment can perform the printing at the print speed of 92 ppm. That is, the second printing unit can output the perfect printed paper at the speed of about 92 ppm. Accordingly, the fifth printing method allows an almost double number of sheets to be printed as compared with the conventional perfect printing, and makes the operation efficient.

In the conventional printing apparatus, to improve the print speed in the perfect printing, it is required to set the print speed in the one-side printing to about twice the print speed of target in the perfect printing. Therefore, there is a problem that the apparatus has a larger size, and the manufacturing cost is increased. However, with the printer of this invention, the perfect printing can be made at the almost same print speed as the one-side printing, whereby it is possible to provide the printer that is smaller in size and more favorable in the manufacturing cost than the conventional apparatus.

<3. One-Side Two-Color Printing>

The one-side two-color printing is performed by a sixth printing method using the first printing unit 2, the second printing unit 3 and the paper conveying unit 4.

(3.1: Sixth Printing Method)

With this printing method, the first printing unit 2 and the second printing unit 3 use different toners. Herein, the printing section 5 of the first printing unit 2 performs the printing using the MICR toner, and the printing section 6 of the second printing unit 3 performs the printing using the non-magnetic toner. In this printing method, the printing section 5 is optimized for the printing with the MICR toner. Herein, the MICR toner is composed of 50 wt % of styrene acrylic resin, 30 wt % of iron oxide, 10 wt % of polymer, 5 wt % of carbon black, and 5 wt % of polyethylene wax.

First of all, the size of paper for use is selected by operating the operation panel. The printer 1 supplies the paper of the selected size from the paper feed trays 20 to 22 to the printing section 5 in the first printing unit.

In the printing section 5, the laser radiating unit 13 radiates a laser 13*a* onto the photosensitive drum 11 in accordance with the MICR font data to form a latent image. The developing unit 14 attaches the MICR toner onto the photosensitive drum 11. And the MICR toner is transferred onto the surface of the fed paper. The transferred toner is fixed on the paper by the heating roller 17*a* and the pressing roller 17*b*. After fixing, the paper is led via the gate 27, the ejecting roller 26 and the paper conveying unit 4 to the second conveying unit 3.

The second printing unit 3 conveys the conveyed paper via the paper conveying passage 9 and the conveying rollers 43 and 43*e* to the printing section 6. The photosensitive drum 31 of the printing section 6 transfers the toner different from the MICR toner onto the fed paper. The transferred toner is fixed on the paper by the heating roller 37*a* and the pressing roller 37*b*. After fixing, the paper is ejected via the ejecting roller 46 onto the paper tray 10*b*. With the above, the one-side two-color printing is completed.

With this method, the printer 1 can singly perform the printing with the MICR font and other printings without preparing a plurality of printers including the monochrome and color printers for the preprint and the specific printer for the MICR printing. Accordingly, it is possible to reduce the installation space for the printer and make effective use of the space.

Moreover, the printer 1 can perform two kinds of printing at the almost same print speed as the monochrome print speed for the conventional printing apparatus. Accordingly, there is no need for taking the time for the preprint, whereby the printing process is performed at high speed and the working efficiency is improved Though the MICR toner and other toners have been exemplified above, the invention is not limited to those toners, but this method is applicable to all the printings using two different toners. For example, the printer 1 can perform the two-color printing with the black toner and the color toner, and the two-color printing with color toners of two different colors.

Also, the usable MICR toner is not limited to the above toners, but all the MICR toners for the MICR printing can be employed.

Though with the above constitution, the first printing unit 2 performs the MICR toner printing, the invention is not limited thereto, but the second printing unit 3 may perform the MICR toner printing and the first printing unit 2 may perform the other toner printing.

<4. Perfect Two-Color Printing>

The perfect two-color printing will be described below. The perfect two-color printing is performed, using a different toner for each one side, one toner for one side and the other toner for both sides, or respective toners for both sides. Herein, a printing method using one toner on one side and the other toner on both sides (seventh printing method) will be described.

(4.1: Seventh Printing Method)

With this printing method, the first printing unit 2 and the second printing method 3 use different toners. Herein, the printing section 5 of the first printing unit 2 performs the one-side printing using the MICR toner, and the printing section 6 of the second printing unit 3 performs the perfect printing using the non-magnetic toner. In this printing method, the printing section 5 is optimized for the printing with the MICR toner.

First of all, the size of paper for use is selected by operating the operation panel. The printer 1 supplies the paper of the selected size from the paper feed trays 20 to 22 to the printing section 5 in the first printing unit.

In the printing section 5, the laser radiating unit 13 radiates a laser 13*a* onto the photosensitive drum 11 in accordance with the MICR font data to form a latent image. The developing unit 14 attaches the MICR toner onto the photosensitive drum 11. And the MICR toner is transferred onto the surface of the fed paper. The transferred toner is fixed on the paper by the heating roller 17*a* and the pressing roller 17*b*. After fixing, the paper is led via the gate 27, the ejecting roller 26 and the paper conveying unit 4 to the second conveying unit 3.

The second printing unit 3 conveys the conveyed paper via the paper conveying passage 9 and the conveying rollers 43 and 43*e* to the printing section 6. The photosensitive drum 31 of the printing section 6 transfers the toner different from the MICR toner onto the same face as the printed face with MICR toner of the fed paper. The transferred toner is fixed on the paper by the heating roller 37*a* and the pressing roller 37*b*. Thereafter, the paper is led via the gate 47 into the lead-in passage 44, and switched back by the reversing rollers 44*a* and 44*b*. The switched back paper is delivered in a reversed state via the return passage 45 to the printing section 6 again.

The photosensitive drum 31 of the printing section 6 transfers the toner onto the back face of the paper passed via the return passage 45. The transferred toner is fixed on the paper by the heating roller 37*a* and the pressing roller 37*b*. After fixing, the paper is conveyed via the ejecting roller 46 onto the paper tray 10*b*. With the above, the perfect two-color printing is completed.

With this method, the printer 1 can singly perform the printing with the MICR font and other printings without preparing a plurality of printers including the monochrome and color printers for the preprint and the specific printer for the MICR printing. Accordingly, it is possible to reduce the installation space for the printer and make effective use of the space.

Moreover, the printer 1 can perform two kinds of printing at the almost same print speed as the monochrome print speed for the conventional printing apparatus. Accordingly, there is no need for taking the time for the preprint, whereby the printing process is performed at high speed and the working efficiency is improved.

Moreover, the printer 1 can perform two kinds of printing at the almost same print speed as the monochrome print speed for the conventional printing apparatus. Accordingly, there is no need for taking the time for the preprint, whereby the printing process is performed at high speed and the working efficiency is improved.

Moreover, in this invention, the first printing unit 2, the second printing unit 3 and the paper conveying unit 4 are separable, and the first printing unit 2 and the second printing unit 3 can be used individually. Accordingly, the service pattern of the apparatus can be flexibly varied depending on the working form of the user. Thereby, it is possible to minimize the installation number of printers and make the printer arrangement efficient in consideration of the environment.

Though the MICR toner and other toners have been exemplified above, the invention is not limited to those toners, but this method is applicable to all the printings using two different toners. For example, the printer 1 can perform the two-color printing with the black toner and the color toner, and the two-color printing with color toners of two different colors.

Also, the usable MICR toner is not limited to the above toners, but all the MICR toners for the MICR printing can be employed.

Though with the above constitution, the first printing unit 2 performs the MICR toner printing, the invention is not limited thereto, but the second printing unit 3 may perform the MICR toner printing and the first printing unit 2 may perform the other toner printing.

The printing on each one side using different toner and the printing on both sides using respective toners are not described here, but can be achieved by switching back and reversing the paper appropriately.

In this embodiment, the laser printer is exemplified, but the invention is applicable to the printers with other methods or the copier.

The Second Preferred Embodiment

Figure 4:
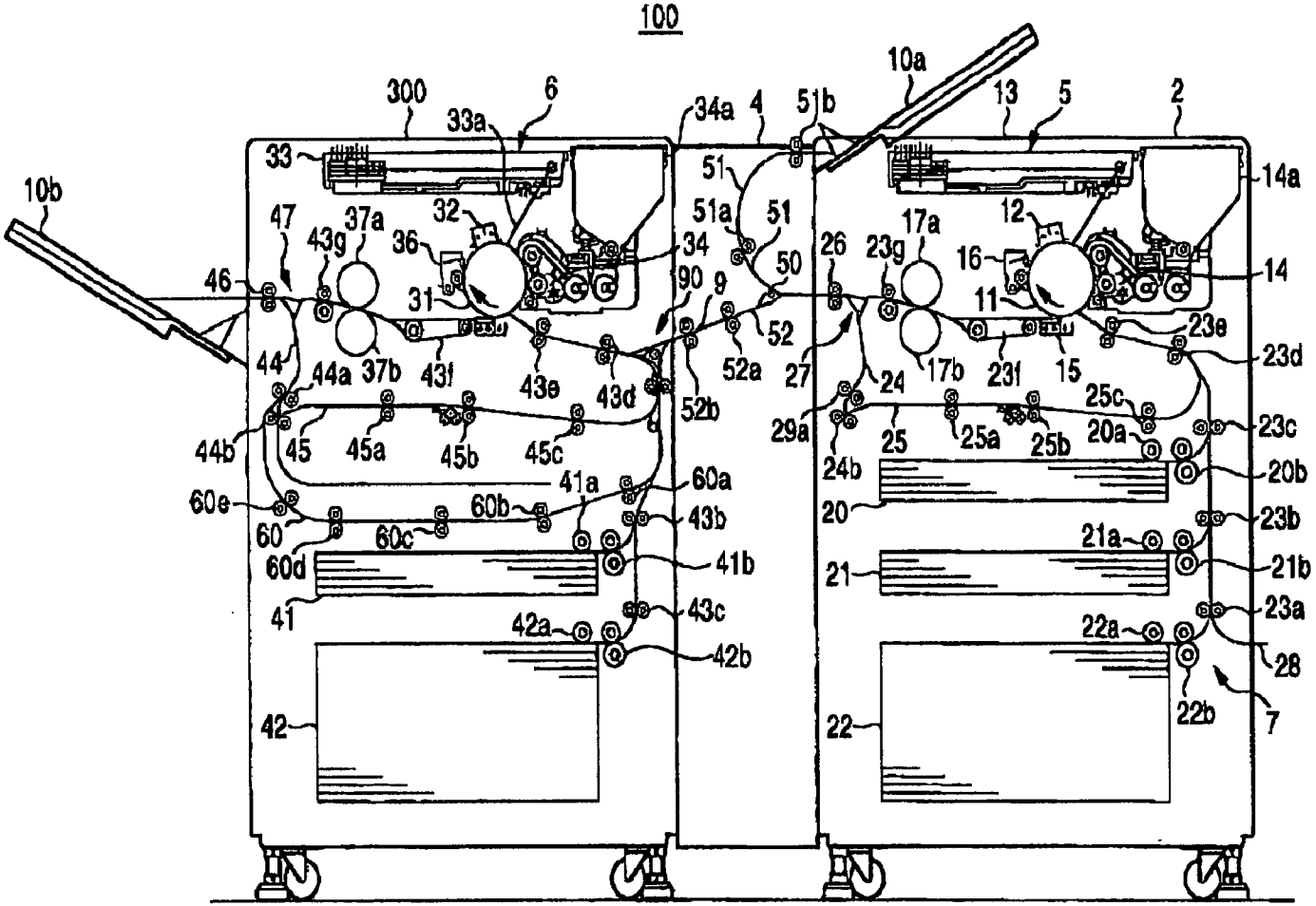
FIG. 4 is a cross-sectional view showing an internal structure of the printer according to a second embodiment of the invention.

A second embodiment of the invention will be described below with reference to the accompanying drawings. In the second embodiment, the description for the same parts as in the first embodiment is appropriately omitted to avoid duplication. FIG. 4 is a cross-sectional view showing an internal structure of a printer 100 according to the second embodiment of the invention. The printer 100 of this embodiment is an image forming apparatus of the electro-photographic method, comprising a first printing unit 2 as a first image forming unit, a second printing unit 300 as a second image forming unit, and a paper conveying unit 4 disposed between the first printing unit 2 and the second printing unit 300.

The second printing unit 300 has no paper tray 40 for the second printing unit 3 as described in the first embodiment, and is provided with a bypass 60. The structure and function of the printing section and other members are the same as for the second printing unit 3.

The bypass 60 has a plurality of conveying rollers 60*a* to 60*e*. One end of the bypass 60 is connected to the reversing roller 44*a*, and the other end is connected via the return passage 45 to the paper conveying passage 9. A gate 70 for selectively delivering the paper passed from the paper conveying unit 4 to the printing section 6 or the bypass 60 is provided at a connection portion with the paper conveying passage 9.

With the printer 100 of the second embodiment, the first printing unit 2 prints the paper, and the second printing unit 300 ejects the printed paper via the bypass to the ejecting tray 10*b*, without the printing section 6. Accordingly, the user can select whether to eject the paper printed by the first printing unit 2 to the ejecting tray 10*a*, or the ejecting tray 10*b*, depending on the use purposes. Particularly, when a bookbinding apparatus is installed instead of the ejecting tray 10*b*, all the printed matter is ejected to the ejecting tray 10*b* to make the book binding efficient in accordance with the embodiment.

With this invention, it is possible to provide an image forming apparatus that can make the fast printing process efficiently and cheaply. Particularly, it is possible to provide an image forming apparatus that can make the MICR printing efficiently, cheaply and reliably. Moreover, it is possible to provide an image forming apparatus that can make the fast perfect printing at lower cost and in smaller size than conventionally.

What is claimed is:

1. An image forming apparatus, comprising:

a first image forming unit comprising a first printing section for forming a first image on a paper;

a second image forming unit comprising a second printing section for forming a second image on the paper; and a paper conveying unit for conveying the paper from the first image forming unit to the second image forming unit, wherein:

the first image forming unit further comprises a first paper supply section for storing paper and supplying paper stored in the first paper supply section to the first printing section, and the second image forming unit further comprises a second paper supply section for storing paper and supplying paper stored in the second paper supply section to the second printing section, a first conveyance passage for transmitting the paper delivered from the paper conveying unit via the second printing section to the outside, and a second conveyance passage for transmitting the paper to the outside while bypassing the second printing section.

2. The image forming apparatus according to claim 1, wherein the first printing section and the second printing section comprise the same recording material.

3. The image forming apparatus according to claim 1, wherein the first printing section and the second printing section comprise different recording materials.

4. The image forming apparatus according to claim 1, wherein at least one of the first printing section and the second printing section comprises a toner.

5. The image forming apparatus according to claim 4, wherein the toner comprises a ferromagnetic toner.

6. The image forming apparatus according to claim 4, wherein the first printing section comprises one of a ferromagnetic toner and a non-magnetic toner, and the second printing section comprises the other of the ferromagnetic toner and the non-magnetic toner.

7. The image forming apparatus according to claim 4, wherein the toner comprises a color toner.

8. The image forming apparatus according to claim 4, wherein the first printing section comprises one of a color toner and a black toner, and the second printing section comprises the other of the color toner and the black toner.

9. The image forming apparatus according to claim 1, wherein the first image forming unit further comprises a first reversing section for reversing the paper on which the first image is formed.

10. The image forming apparatus according to claim 9, wherein the first reversing section delivers the reversed paper to the first printing section or the paper conveying unit.

11. The image forming apparatus according to claim 10, wherein the first image forming unit forms a third image on the paper delivered from the first reversing section.

12. The image forming apparatus according to claim 9, wherein the second image forming unit further comprises a second reversing section for reversing the paper on which the second image is formed and for delivering the paper to the second printing section or to the outside.

13. The image forming apparatus according to claim 12, wherein the first image forming unit forms a third image on the paper delivered from the first reversing section, and the second image forming unit forms a fourth image on the paper delivered from the second reversing section.

14. The image forming apparatus according to claim 1, wherein the paper conveying unit comprises a first conveyance passage for passing the paper from the first image forming unit to the second image forming unit, and a second conveyance passage connected to the first conveyance passage, for transmitting the paper to the outside.

15. The image forming apparatus according to claim 1, wherein the first image forming unit and the second image forming unit are detachable so as to be respectively detached from the paper conveying unit.

16. The image forming apparatus according to claim 15, wherein each of the first image forming unit and the second image forming unit is adapted to form an image on the paper and output the paper independently.

17. The image forming apparatus according to claim 1, wherein the first printing section is exchangeable for the second printing section.

18. The image forming apparatus according to claim 1, wherein:

the first image forming unit comprises a magnetic ink character recognition printing unit for performing magnetic ink character recognition printing on one side of the paper; and the second image forming unit comprises a non-magnetic toner printing unit for performing non-magnetic toner printing on both sides of the paper.

19. The image forming apparatus according to claim 1, wherein the second image forming unit further comprises a reversing section for reversing the paper on which the second image is formed.

20. The image forming apparatus according to claim 19, wherein the first image forming unit further comprises a reversing section for reversing the paper on which the first image is formed.

21. The image forming apparatus according to claim 1, wherein the second conveyance passage is connected to the first conveyance passage.

22. An image forming apparatus, comprising:

a first image forming unit comprising a first printing section for forming a first image on a paper;

a second image forming unit comprising a second printing section for forming a second image on the paper; and a paper conveying unit for conveying the paper from the first image forming unit to the second image forming unit, wherein the second image forming unit further comprises a first conveyance passage for transmitting the paper delivered from the paper conveying unit via the second printing section to the outside, and a second conveyance passage connected to the first conveyance passage, for transmitting the paper to the outside while bypassing the second printing section.

* * * * *